United States Patent [19]

Kojima

[11] Patent Number: 5,066,551

[45] Date of Patent: Nov. 19, 1991

[54] ELECTROLUMINESCENT SHEET ELEMENT

[75] Inventor: Kiyoaki Kojima, Tokyo, Japan

[73] Assignee: Clarion Co., Ltd., Tokyo, Japan

[21] Appl. No.: 468,761

[22] Filed: Jan. 23, 1990

[30] Foreign Application Priority Data

Jan. 27, 1989 [JP] Japan ..... 1-18094

[51] Int. Cl.[5] ..... H05B 33/26

[52] U.S. Cl. ..... 428/690; 313/506; 313/509

[58] Field of Search ..... 428/690, 917; 313/491, 313/492, 506, 509

[56] References Cited

U.S. PATENT DOCUMENTS 3,161,797 12/1964 Butler et al. ..... 313/108

4,767,679 1/1987 Kanachi ..... 313/108

*Primary Examiner*—James J. Seidleck

*Assistant Examiner*—Charles R. Nold

*Attorney, Agent, or Firm*—Flynn, Thiel, Boutell & Tanis

[57] ABSTRACT

An electroluminescent sheet element includes and intermediate electrode and a thin insulating layer between a fluorescent layer and an insulating layer to enable injection of high-energy electrons in the fluorescent layer.

5 Claims, 3 Drawing Sheets

ELECTROLUMINESCENT SHEET ELEMENT

FIELD OF THE INVENTION

This invention relates to an improved electroluminescent sheet element.

BACKGROUND OF THE INVENTION

A conventional electroluminescent sheet element, as shown in a schematic cross-sectional view of FIG. 3, includes a fluorescent layer 1, used as a light emitting layer, sandwitched by insulating layers 2—2, with an AC voltage applied between a metal electrode 3 and a transparent electrode 4, so as to emit light from the fluorescent layer 1. Reference numeral 5 denotes a glass substrate.

The light emitting theory of the above electroluminescent sheet element is generally explained as follows, using an energy band schematic view of FIG. 4.

Electrons are discharged from the level of an interface between the fluorescent layer and the insulating layer or its neighborhood in the cathode's side to the transmission band of the fluorescent layer due to a tunnel effect. These electrons are accelerated in receipt of an energy from the electric field. At this time, the electrons excite the grating, and multiplication of electrons also occurs. Further, the electrons hit the light emission centers (for example, $MN^{2+}$ions) of the fluorescent layer and excite them. When the light emission centers L are returned from the excited state to the basic state, light is emitted. After this, the electrons are caught by the level of the interface between the fluorescent layer and the insulating layer in the anode's side. This is an alternation of the anode and the cathode, and it is repeated in sequence.

In the aforegoing light emitting theory, it is understood that the number of discharged electrons from the level of the interface between the insulator and the fluorescent layer to the transmission band of the fluorescent layer is determined by the density and the energy distribution, etc. of the interface level and that the interface level density and the energy distribution, etc. depend on the materials, crystal properties, layer-making methods, etc. of insulating and fluorescent layers. However, it is not yet possible to make the electroluminescent element under controls of the interface level density, energy distribution, etc.

Therefore, taking an electroluminescent sheet element using ZnS:Mn fluorescent layer, for example, as far as the same ZnS fluorescent layer manufacturing condition is used, various dielectric layers such as $Y_2O_3$, $SiO_2$, $SiN_4$, $Al_2O_3$, etc. as insulating layers does not provide large differences in the brightness and in the amount of moving electric charges under the same electric field intensity in the fluorescent layer. Its reason would be that varieties of materials of the insulating layers do not make large differences in the density and the distribution of the interface level and that since ZnS fluorescent layers formed under the same manufacturing condition are used, multiplication and scattering of electrons are in the substantially same degrees.

In this conventional arrangement, an increase in the amount of the moving electric charges caused by an increase of the number of injected electrons is not expected under the same electric field of the fluorescent layer, and an increase in the brightness is not expected either.

OBJECT OF THE INVENTION

It is therefore an object of the invention to provide an electroluminescent sheet element capable of supplying more electrons to a fluorescent layer than a conventional arrangement under the same condition of electric field in the fluorescent layer and capable of establishing a high brightness even with the same efficiency.

SUMMARY OF THE INVENTION

According to the invention, there is provided an electroluminescent sheet element comprising:

a fluorescent layer;

first insulating layers provided on opposite surfaces of said fluorescent layer;

a second thin insulating layer provided adjacent to said fluorescent layer in at least one of interfaces between said first insulating layers and said fluorescent layer; and an intermediate electrode provided adjacent to said first insulating layer in at least one of interfaces between said first insulating layers and said fluorescent layer.

In the electroluminescent sheet element having the above-described arrangement, hot electrons can be injected from the intermediate electrode to the fluorescent layer through the thin insulating layer, using a tunnel effect, and a further effect of injection of hot electrons from the intermediate electrode is added to the injection of electrons from the interface level between the insulating layer and the fluorescent layer.

DETAILED DESCRIPTION

Figure 1A:
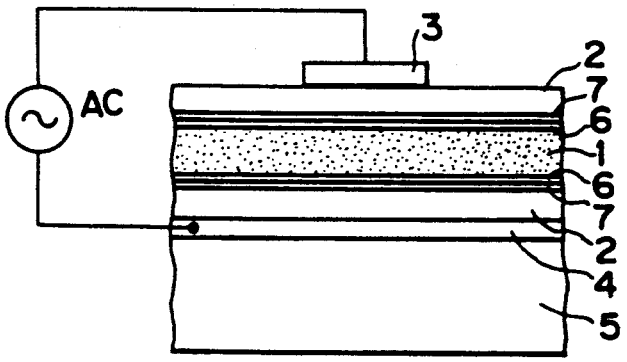
FIGS. 1A through 1C are schematic cross-sectional views of electroluminescent sheet elements embodying the invention.
Figure 3:
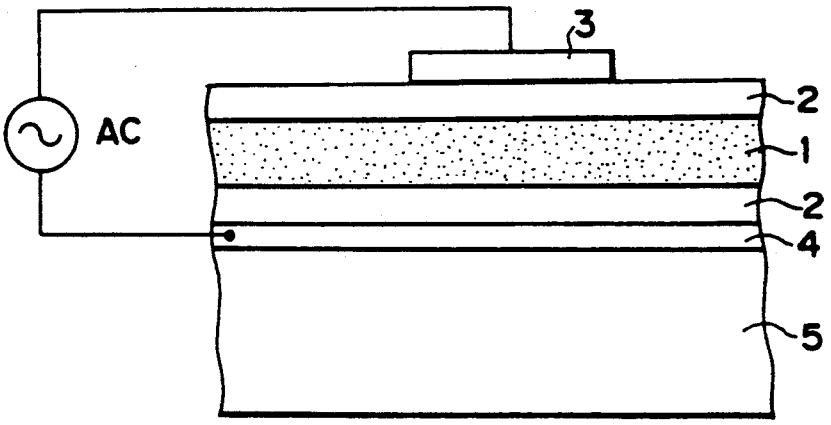
FIG. 3 PRIOR ART
FIG. 3 is a schematic cross-sectional view of a conventional electroluminescent sheet element.
Figure 4:
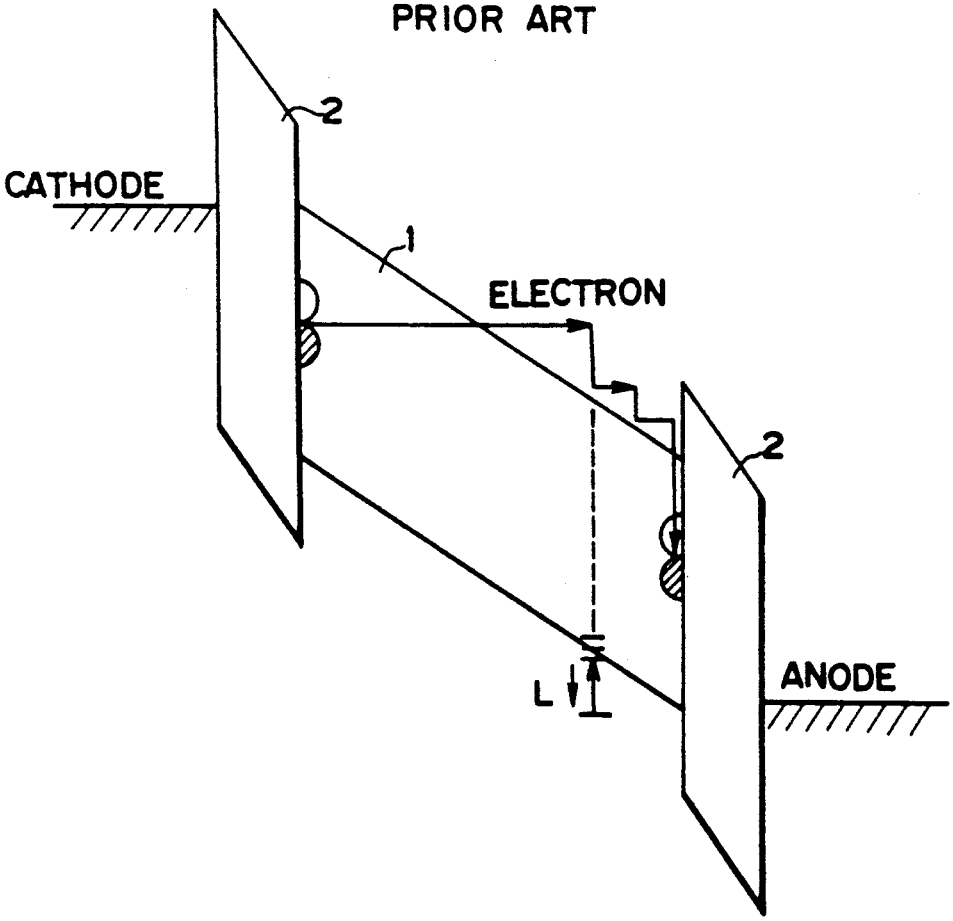
FIG. 4 PRIOR ART
FIG. 4 is its energy band schematic view.

FIG. 1A is a schematic cross-sectional view of an electroluminescent sheet element embodying the invention, including the same or equivalent elements or members as those of FIG. 3 bearing the same reference numerals.

This embodiment is different from the conventional electroluminescent sheet element in that a thin insulating layer 6 and an intermediate electrode 7 are inserted between the fluorescent layer 1 and each insulating layer 2 (hereinafter called "thick insulating layer"), with the thin insulating layer 6 faced to the fluorescent layer 1 and the intermediate electrode 7 faced to the thick insulating layer 2.

The intermediate electrode 7 may be in the form of a metal layer of Al, Au, etc., a transparent electrode of ITO (Indium Tin Oxide), etc. or an n-type semiconductor layer ($10^{18} \sim 10^{21}$ $cm^{-3}$, approximately) which is doped with donors in a very high concentration. In case of using such a metal or semiconductor layer, however, the intermediate electrode 7 in the light extracting side must be thin enough to transmit light.

Under this arrangement, it is possible to inject hot electrons from the intermediate electrode 7 into the fluorescent layer 1 through the thin insulating layer 6 (10~100Å, approximately), using the tunnel effect (refer to Physics of Semiconductor 2nd Edition by S.M. Sze, pp 558-562).

By the use of the aforegoing arrangement, in the electric field of $1\sim2\times10^6$V/cm , for example, where the fluorescent layer starts light emission, hot electrons as a result of the tunnel effect from the intermediate electrode are added to injection of electrons from the interface level between the insulating layer 2 and the fluorescent layer 1. Assuming that the efficiency expressed hereunder is constant, the amount ΔQ of the moving electric charges in the denominator increases, and hence the brightness B in the numerator also increases.

$$\text{Efficiency } \eta\ [lm/W] = \frac{\pi \cdot B\ [cd/\mathrm{m}^2]}{Pin\ [W/\mathrm{cm}^2]} \times 10^{-4}$$

$$(\text{where } Pin = f\,[\mathrm{Hz}] \cdot Vth \cdot \Delta Q\ [c/\mathrm{cm}^2])$$

Further, since the electrons which are tunnel-injected from the intermediate electrode 7 are injected as hot electrons having a high energy, the exciting efficiency of the light emission centers is improved, and as a result, an improvement in the efficiency is also expected.

Figure 1B:
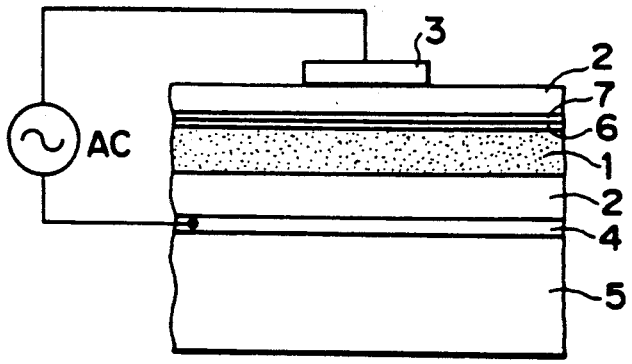
Figure 1C:
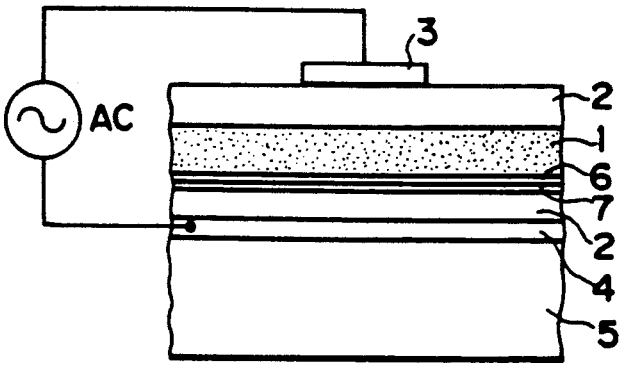
Figure 2:
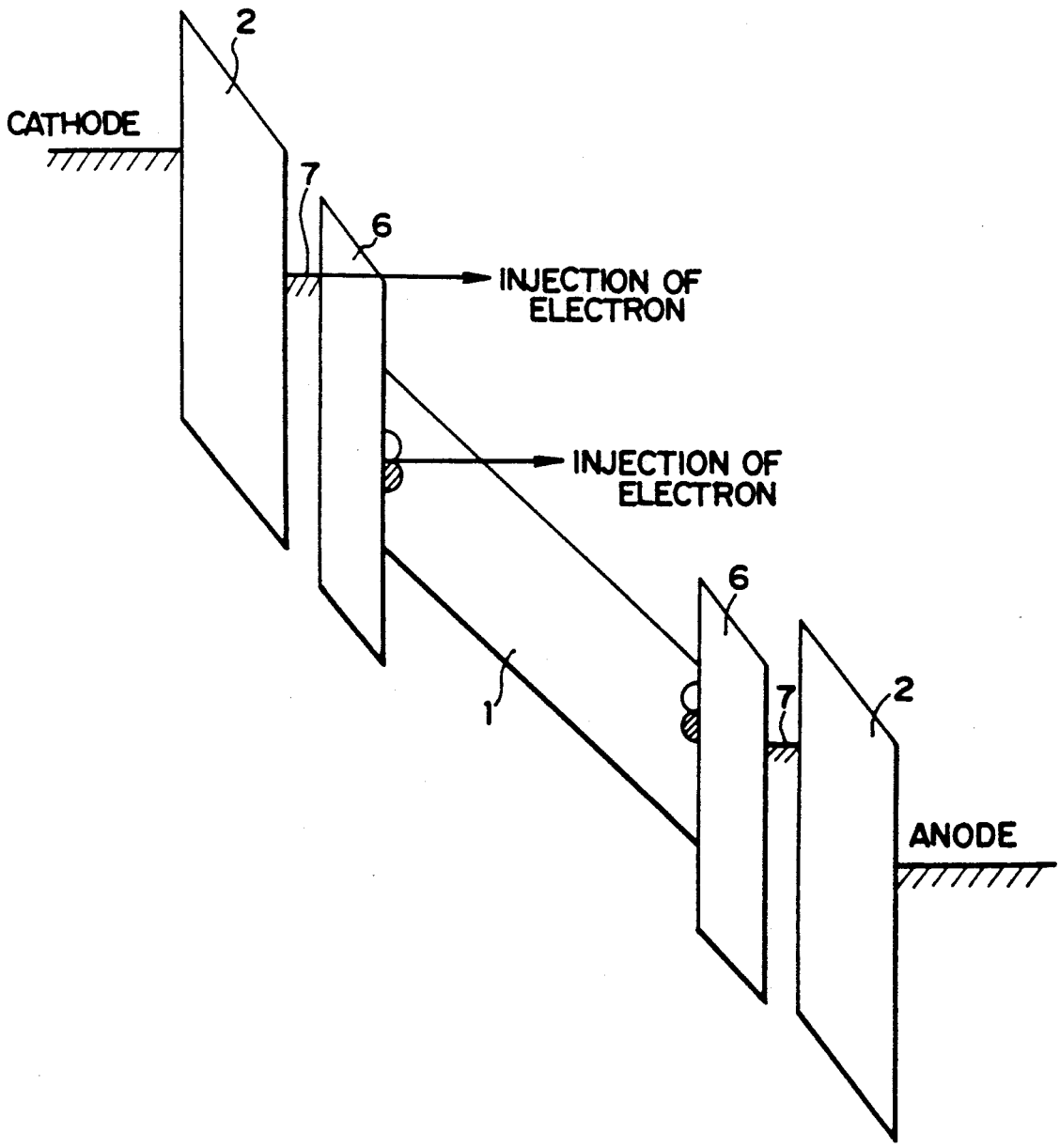
FIG. 2 is their energy band schematic view.

FIG. 1B and 1C show further embodiments of the invention. As apparently understood from the drawings, the insulating layer 6 and the intermediate electrode 7 may be provided in one of interfaces between the fluorescent layer 1 and the insulating layers 2.

As described above, according to the invention, the number of injected electrons is increased as compared under the same electric field of the fluorescent layer, and the amount of moving electric charge is increased. Therefore, under the same efficiency, the brightness is increased.

Further, as understood from the energy band schematic view, since the intermediate electrode acts as the injection source of hot electrons, the exciting efficiency is improved. That is, since there is the following relationship:

$$\text{Exciting Efficiency} = \frac{\text{Number of excited light emitting centers}}{\text{Number of moving electrons}}$$

injection of high electrons increases the ratio of the exciting light emitting centers relative to the number of moving electrons, and this improves the entire efficiency.

What is claimed is:

1. An electroluminescent sheet element comprising:

a fluorescent layer;

first insulating layers provided on opposite sides of said fluorescent layer;

a second thin insulating layer provide adjacent to said fluorescent layer between one of said first insulating layers and said fluorescent layer; and an intermediate electrode provided adjacent to said one of said first insulating layers between said one of said first insulating layers and said second thin insulating layer.

2. The electroluminescent sheet element according to claim 1 wherein said intermediate electrode is in the form of a metal layer.

3. The electroluminescent sheet element according to claim 1 wherein said intermediate electrode is in the form of a transparent electrode.

4. The electroluminescent sheet element according to claim 1 wherein said intermediate electrode is in the form of an n-type semiconductor layer high-concentrated-doped with donors in a very high concentration.

5. The electroluminescent sheet element according to claim 1 wherein said second thin insulating layer is 10 to 100Å thick approximately.

* * * * *